US007637693B2

(12) United States Patent
Dreyer

(10) Patent No.: US 7,637,693 B2
(45) Date of Patent: Dec. 29, 2009

(54) BOOM SUPPORT ARM AND USE THEREOF

(75) Inventor: Harold B. Dreyer, Anchorage, AK (US)

(73) Assignee: Gunderboom, Inc., Anchorage, AK (US)

( * ) Notice: Subject to any disclaimer, the term of this patent is extended or adjusted under 35 U.S.C. 154(b) by 629 days.

(21) Appl. No.: 10/994,718

(22) Filed: Nov. 22, 2004

(65) Prior Publication Data

US 2005/0117972 A1 Jun. 2, 2005

Related U.S. Application Data

(60) Provisional application No. 60/524,201, filed on Nov. 21, 2003.

(51) Int. Cl.
*E02B 15/04* (2006.01)

(52) U.S. Cl. ..... 405/63

(58) Field of Classification Search ..... 405/60, 405/63–72; 210/922–924; 114/240 B, 123, 114/263, 360, 362, 222, 241, 240 A, 240 C, 114/240 D, 240 E, 240 R, 10, 14; 441/86; 14/69.5, 71.1, 71.3
See application file for complete search history.

(56) References Cited

U.S. PATENT DOCUMENTS 1,130,528 A * 3/1915 McGray ..... 114/362
3,983,034 A * 9/1976 Wilson ..... 210/776
4,399,338 A * 8/1983 Jones ..... 200/84 R
4,838,735 A * 6/1989 Warner ..... 405/220
4,925,709 A * 5/1990 Shmueli ..... 428/33
5,094,744 A * 3/1992 Scovell ..... 210/242.3
5,102,261 A 4/1992 Gunderson, III
6,485,229 B1 11/2002 Gunderson, III et al.
6,778,469 B1 * 8/2004 McDonald ..... 367/136

FOREIGN PATENT DOCUMENTS

JP 5648423 * 5/1981
JP 57151715 * 9/1982

* cited by examiner

*Primary Examiner*—Sunil Singh
(74) *Attorney, Agent, or Firm*—Nixon Peabody LLP

(57) ABSTRACT

A boom support arm that includes: a frame having a coupling positioned above a high water level; a support arm having a first end and a second end, the first end being pivotally coupled to the coupling on the frame for pivotal movement of the second end of the support arm between the high water level and a low water level; and a flotation assembly connected to the second end of the support arm. Use of the boom support arm in combination with a floating boom system for inhibiting damage to a fixed terminus of the floating boom system is also disclosed.

17 Claims, 4 Drawing Sheets

BOOM SUPPORT ARM AND USE THEREOF

This application claims the priority benefit of provisional U.S. Patent Application Ser. No. 60/524,201, filed Nov. 21, 2003, which is hereby incorporated by reference in its entirety.

FIELD OF THE INVENTION

The present invention relates generally to a boom support arm and its use for supporting a portion of a boom whose terminal end is fixed to a structure, which end would otherwise experience significant strain damage as a consequence of cyclical rising and falling of the boom under tidal conditions or under adverse wave conditions.

BACKGROUND OF THE INVENTION

Floating boom systems that are used in marine and aquatic environments sometimes must be affixed at one or both ends thereof to a fixed structure that is part of the natural or man-made shoreline. The flexible boom systems often cannot tolerate the shear stresses that are developed at these attachment points as a result of the cyclical rising and falling of water column caused by tidal effects or adverse weather-related wave action.

The present invention is directed to overcoming this and other deficiencies in the art.

SUMMARY OF THE INVENTION

A first aspect of the present invention relates to a boom support arm that includes: a frame having a coupling positioned above a high water level; a support arm having a first end and a second end, the first end being pivotally coupled to the coupling on the frame for pivotal movement of the second end of the support arm between the high water level and a low water level; and a flotation assembly connected to the second end of the support arm. In one preferred embodiment, the boom support arm also contains one or more connectors adapted for connecting the support arm to a boom. In another preferred embodiment, the flotation assembly is pivotally connected to the second end of the support arm.

A second aspect of the present invention relates to a combination of a boom support arm of the present invention with a boom that contains one or more flotation units and a curtain connected to the one or more flotation units, the curtain being formed of a flexible fabric material that allows the flow of water therethrough and having a terminal end secured to a shoreline structure. By connecting the curtain to the support arm, a portion of the boom located between the terminal end of the boom and the second end of the support arm becomes suspended from the support arm to support the weight of the curtain as the curtain rises and falls (i.e., from high water level to low water level and back again).

A third aspect of the present invention relates to a method of inhibiting damage to a fixed terminus of a floating boom system that includes the steps of: providing a boom support arm of the present invention; providing a floating boom system having a fixed terminus that is secured to a shoreline structure, the floating boom system comprising a plurality of flotation units and a curtain suspended from the flotation units; and connecting a portion of floating boom system to the boom support arm, between the fixed terminus and the second end of the support arm, using one or more connectors; wherein the boom support arm supports the portion of the floating boom system and thereby inhibits damage to the floating boom system as the boom system oscillates between high and low water levels.

The effect of the boom support arm is to more gradually taper the sloping of the boom from its point of connection to a fixed on-shore support to the high or low water level and, more particularly, to support the weight of the boom in this region. As a result of supporting a portion of the boom located between the fixed terminal end of the boom and the second end of the support arm, much stress is alleviated from the point of connection to the fixed on-shore connection. The support arm will either eliminate or at least minimize the frequency of replacing terminal boom sections as a result of fatigue and failure caused by such stress. This will save the site operator significant expense of replacing parts as well as avoid the need to shut down water intake systems during repair.

DETAILED DESCRIPTION OF THE INVENTION

The present invention relates generally to a boom support arm that is intended to support a portion of a floating boom system between an end of the boom support arm and the terminal end of the boom curtain. In particular, the boom support arm can inhibit or, preferably, completely prevent failure of the terminal end of the curtain, which would otherwise occur in response to oscillation of the floating boom system between high and low water levels.

Figure 1:
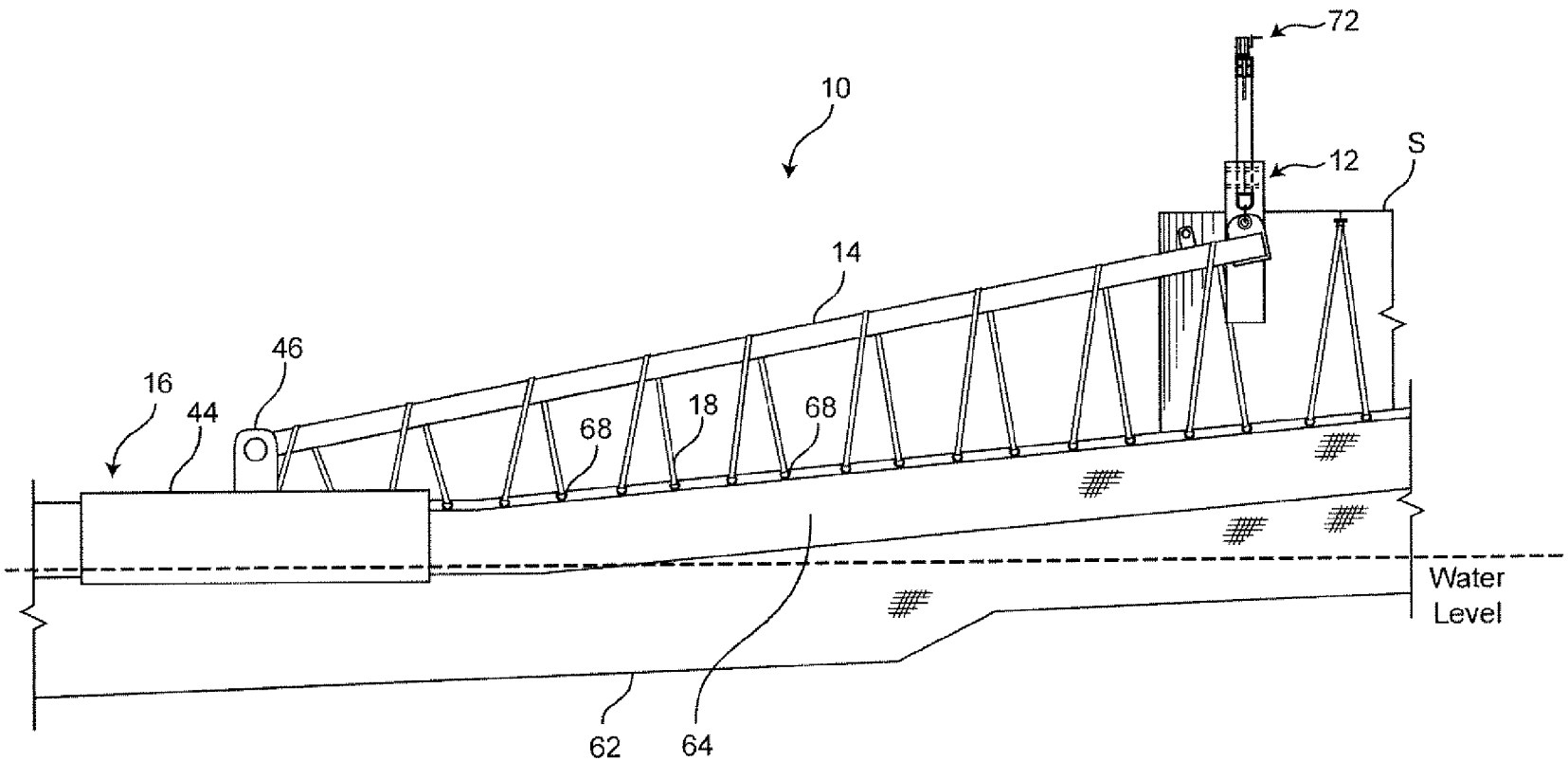
FIG. 1 is a side elevational view of a boom support arm in use, with one end of the support arm connected to a frame secured to a fixed on-shore structure, and the boom support arm coupled to a floating boom system.

Referring now to FIG. 1, the boom support arm 10 generally includes a frame 12, support arm 14, flotation assembly 16, and one or more connectors 18. In use, shown in FIG. 1, the boom support arm 10 is intended to support a floating boom system 60 that is characterized by a curtain 62 having a hood portion 64 that contains a plurality of flotation billets as is known in the art. The curtain includes a terminal section 66 that is connected to a fixed, shoreline structure S. The curtain is preferably formed of a flexible fabric material that allows the flow of water therethrough, which allows use of the curtain as a filtration system for, e.g., an industrial water intake structure. The general structure of the curtain and the floating boom system in its entirety are described, for example, in U.S. Pat. No. 5,102,261 to Gunderson III and U.S. Pat. No. 6,485,229 to Gunderson III, et al., each of which is hereby incorporated by reference in its entirety. The boom curtain 60, including the terminal section 66 thereof, is preferably formed of a geosynthetic material. In a preferred embodiment, the terminal section 66 can be formed of one geosynthetic material, preferably the geosynthetic material XR-5, and the remainder of the curtain can be formed of another suitable geosynthetic material.

Figure 2:
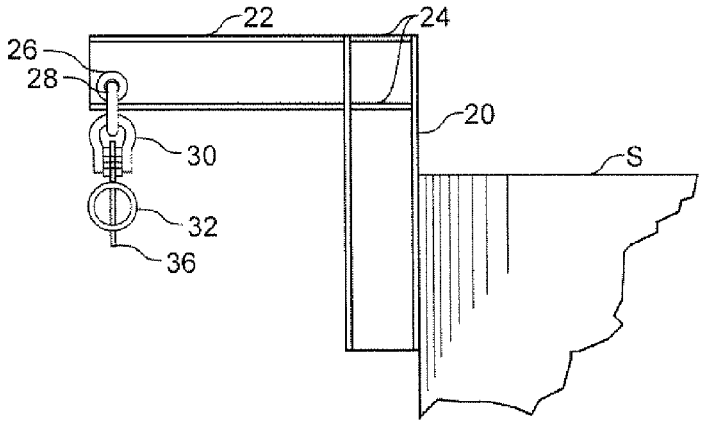
FIG. 2 is an end elevational view of the frame coupled to one end of the support arm.
Figure 3:
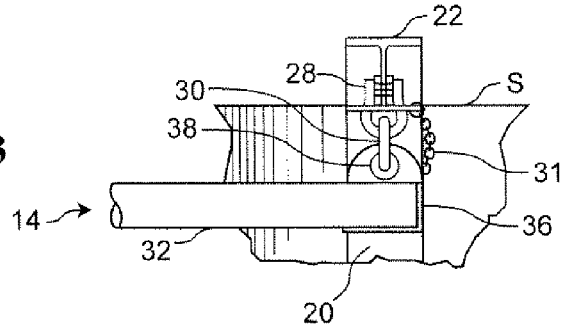
FIG. 3 is a partial, enlarged side view of the coupling between the support arm and the frame.

The configuration of the frame 12 can vary as long as the configuration is stable to support the weight of the support arm 14 and the portion of the boom 60 coupled thereto, and to maintain a coupling above a high water level. As shown in FIG. 1-3, frame 12 is supported on a fixed shoreline structure S that is a manmade structure formed by welded connection of a plurality of sheet piling. The frame 12 can be secured to the structure S by welding. In a preferred embodiment, the frame 12 is formed of a substantially vertical beam 20 secured to the structure S, and an integrally connected substantially horizontal beam 22. The beams 20 and 22 are preferably of a steel I-beam construction, and are connected together via welding and reinforced via stiffeners 24, affording a structure having an inverted L-shape construction. The distal end of the substantially horizontal beam 22 is provided with an aperture 26. To provide access to aperture 26, the lower flange of the I-beam construction can be removed, if necessary.

The coupling is provided for pivotally connecting the support arm 14 to the frame 12. The coupling is preferably in the form of a pair of shackles 28,30 that are linked together. This first shackle 28 is coupled to the substantially horizontal beam via aperture 26 and the second shackle 30, which interlocks with the first shackle, is coupled to one end of the support arm 14. (The cotter pin of the second shackle is effectively the pivot point about which the support arm freely pivots.) A safety chain 31 is provided in the event of failure of the shackle connection.

Figure 4:
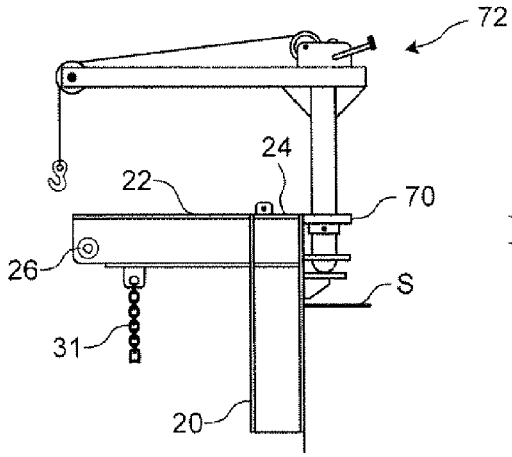
FIG. 4 is an end elevational view of an alternative frame construction that includes a winch device.

In an alternative embodiment illustrated in FIG. 4, the frame 12 can also include a receptacle 70 for stable mounting of a winch 72. The winch 72 can be used to support the first end 14 of the support arm 14 during installation, in which case the weight of the support arm 14 can be borne by the winch so that the shackles 28,30 can easily be coupled to the one another. After coupling, the winch can be released so that the weight of the support arm 14 is borne by the frame 12.

Figure 5:
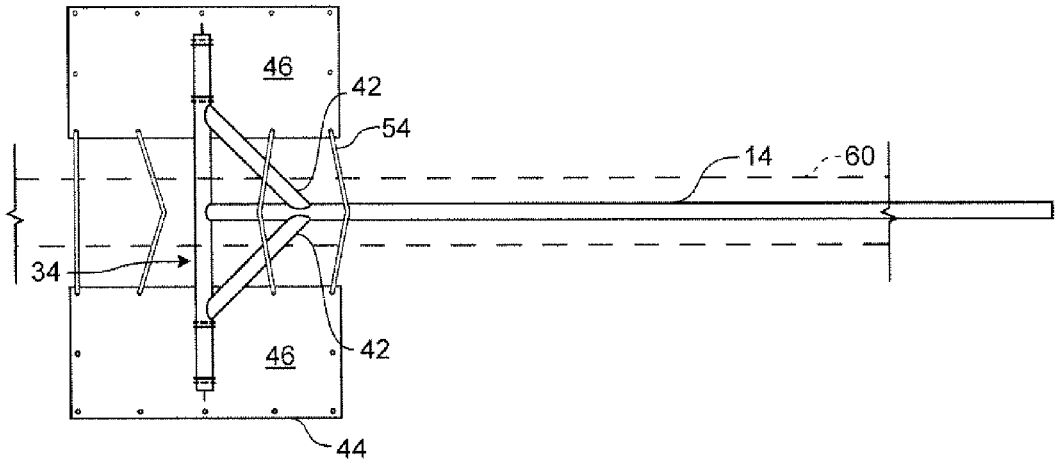
FIG. 5 is a plan view of the support arm and flotation assembly. The boom system and connectors, for tethering the boom system to the support arm, are shown in phantom lines in this figure.
Figure 6:
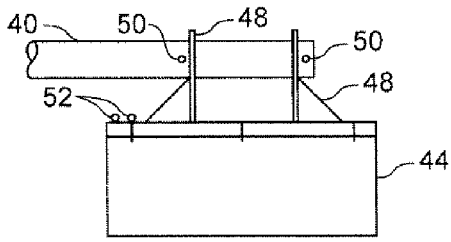
FIG. 6 is an enlarged, partial end view of one flotation member and its connection to a cross-bar of the support arm.

The support arm 14 can have any suitable configuration that allows for stable support of the weight of the boom and the intended pivotal movement thereof. The support arm 14 has a first end 32 and a second end 34. The first end 32 has a plate 36 welded within a slot formed therein. Upon coupling of the second shackle 30 to an aperture 38 of the plate 36, the first end of the support arm 14 is suspended from the frame 12 for pivotal movement of the second end of the support arm between a high water level and a low water level. As shown in FIGS. 5-6, a preferred configuration of the support arm 14 is such that the second end 34 is T-shaped, having a cross-bar 40 and on either side of the main arm a beveled stiffener bar 42. The various components that form the support arm 14 are preferably formed of 6" diameter steel pipe.

The flotation assembly 16 can have any configuration that allows the second end 34 of the support arm to remain buoyant, regardless of the load applied thereto during use. In a preferred embodiment, the flotation assembly is pivotally connected to the second end of the support arm. The configuration illustrated in FIG. 5 is that of a pair of flotation members 44, one connected to one side of the T-shaped second end 34 and the second flotation member being connected to the other side of the T-shaped second end.

In a preferred embodiment, each flotation member 44 is a flotation box (e.g., model 4896-20 available from Dock Boxes Unlimited). Mounted to each flotation box by appropriate connectors (e.g., ⅜ inch steel bolts) is a mounting flange 46. The mounting flange has connected thereto, e.g., by welding, a pair of brackets 48 that each have an aperture that is shaped and configured to receive the cross-bar 40 of the second end of the support arm 14. The brackets 48 are co-aligned to do so; together they form a bearing surface, allowing the second end of the support arm 14 to pivot. Once the cross-bar is received through the apertures, a pair of bolts 50 pass substantially diametrically through the cross-bar to preclude unwanted separation of the flotation member from the cross-bar. The upper side of the mounting flange is also provided with a plurality of eye bolts (or eye rings) 52.

The support arm further includes one or more connectors 54, each spanning between corresponding eye rings 52 associated with the first and second flotation members 44. These connectors are preferably in the form of nylon coated steel wire. These connectors allow the flotation members 44 to tightly sandwich the boom 60 therebetween.

To support the boom 60 by the support arm 14, the curtain 62 is connected to the support arm by one or more elastic connectors 18, e.g., bungee cords. To facilitate connection of the curtain to the support arm, the upper edge of the curtain, i.e., within the region between the second end of the support arm and the terminal end of the curtain, is provided with a plurality of grommets 68 formed therein. According to one embodiment, the connector 18 is a single connector spanning the entire length of the support arm. According to another embodiment, the connector 18 is in the form of a plurality of such connectors. Regardless of the embodiment, the connector(s) 18 pass through the grommets, around the support arm, and back through an adjacent grommet. This is best shown in FIG. 1.

It should be further appreciated by those of ordinary skill in the art that low friction coating materials can be provided at various pivot points so as to minimize the likelihood of wear and fatigue that can be caused by contact between moving metal parts. Thus, the brackets 48 or cross-bar 40 can be provided, e.g., with a polyethylene coating or sleeve to act as the actual bearing surface. Likewise, the connection between the second shackle 30 and the plate 36 can similarly be coated or provided with a sleeve.

To enhance corrosion resistance of steel parts, those parts can be painted or powder coated, or otherwise treated in a manner consistent to that end.

Figure 7:
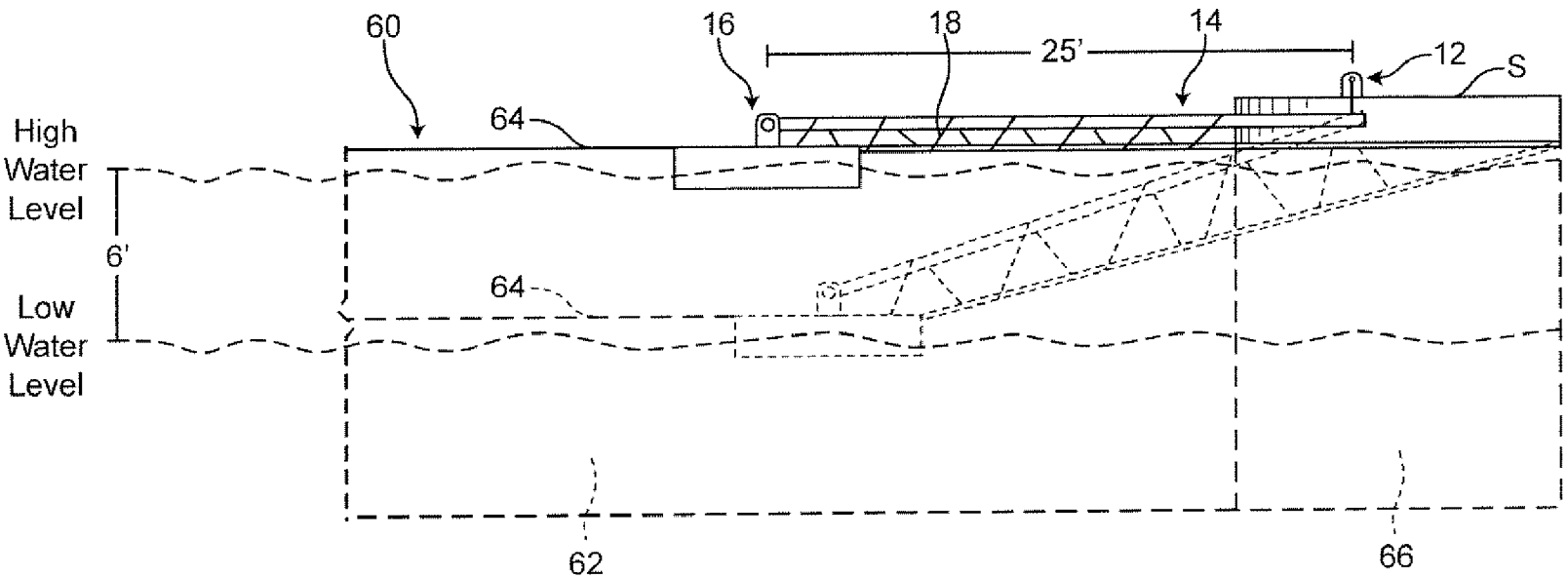
FIG. 7 is an environmental plan view of the support arm fixed to an on-shore structure. The movement of the boom support arm in response to water level fluctuation (i.e., between high and low water levels) is shown.

As shown in FIG. 7, the length of the boom is about 25 feet when the predicted vertical change in water level is about 6 feet. This equates to slightly more than a 4:1 ratio. In keeping with the present invention, any suitable ratio can be selected, however the ratio is preferably between about 3:1 to about 6:1, which avoids unnecessary expense of additional materials while providing the effective inhibition of shear forces.

In use, after coupling the first end of the support arm 14 in the manner described above and lashing the upper edge of the curtain 60 to the support arm in the manner described above, the bottom of the curtain is preferably anchored so as to minimize lateral shifting of the boom curtain. Anchoring can be achieved on only one side of the curtain or on both sides, which is preferred. Lateral shifting, if excessive, can damage the support arm 14 or its connection to the frame 12. The shackle connection allows some limited movement outside of a substantially planar alignment.

To the extent that repair of the curtain 60 or the support arm 14 components is required, the support arm can be de-coupled from the frame 12 and/or the curtain to allow for such repair. It should be noted, however, that such repair is expected to be minimal given the reduction in sheer forces applied to the curtain.

Thus, a further aspect of the present invention relates to a method of inhibiting damage to a fixed terminus of a floating boom system. This method is carried out by providing a boom support arm of the type described above, providing a floating boom system having a fixed terminus that is secured to a shoreline structure, the floating boom system including a plurality of flotation units and a curtain suspended from the flotation units; and then connecting a portion of floating boom system to the boom support arm, between the fixed terminus and the second end of the support arm, using one or more connectors. The result of this configuration is that the support arm can reduce the sheer forces applied to the connection of the curtain to the shoreline structure, primarily by supporting the weight of the curtain (between the second end of the support arm and the terminal connection) over the entire length of the support arm. Consequently, the present invention inhibits damage to the floating boom system as the boom system oscillates between high and low water levels.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed:

1. A boom system and boom support arm in combination comprising:

a boom comprising one or more flotation units and a curtain connected to the one or more flotation units, the curtain being formed of a flexible fabric material that allows the flow of water therethrough and having a terminal end secured to a shoreline structure; and a boom support arm comprising:

a frame connected to a fixed, on-shore structure and having a coupling positioned above a high water level, a support arm comprising a first end and a second end, the first end being pivotally coupled to the coupling on the frame for pivotal movement of the second end of the support arm between the high water level and a low water level, a flotation assembly connected to the second end of the support arm, and one or more connectors connecting the boom to the support arm to suspend a portion of the boom located between the terminal end of the boom and the second end of the support arm.

2. The combination according to claim 1 wherein the curtain has an upper edge comprising a plurality of grommets formed therein, the grommets receiving the one or more connectors.

3. The combination according to claim 1 wherein the one or more connectors pass through one grommet, around the support arm, and then through another grommet.

4. The combination according to claim 1 wherein the second end of the support arm is T-shaped.

5. The combination according to claim 4 wherein the flotation assembly is pivotally connected to the second end of the support arm.

6. The combination according to claim 4 wherein the flotation assembly comprises first and second flotation members, the first flotation member being connected to one side of the T-shaped second end and the second flotation member being connected to the other side of the T-shaped second end.

7. The combination according to claim 6 wherein each of the first and second flotation members comprises at least one flotation box and a mounting flange secured to each flotation box.

8. The combination according to claim 7 wherein the mounting flange comprises a plurality of eye rings.

9. The combination according to claim 8 further comprising one or more second connectors, each spanning between an eye ring associated with the first flotation member and an eye ring associated with the second flotation member.

10. The combination according to claim 1 wherein the curtain comprises a terminal section.

11. The combination according to claim 10 wherein the curtain and the terminal section thereof are both formed of geosynthetic materials.

12. The combination according to claim 1 wherein the length of the boom arm is about three to about six times the distance between high and low water levels at the shoreline structure.

13. The combination according to claim 12 wherein the length of the boom arm is about four times the distance between high and low water levels at the shoreline structure.

14. The combination according to claim 1 wherein the one or more connectors are elastic connectors.

15. A method of inhibiting damage to a fixed terminus of a floating boom system comprising:

providing a boom support arm comprising a frame connected to a fixed, on-shore structure and having a coupling positioned above a high water level, a support arm comprising a first end and a second end, the first end being pivotally coupled to the coupling on the frame for pivotal movement of the second end of the support arm between the high water level and a low water level, a flotation assembly connected to the second end of the support arm, and one or more elastic connectors;

providing a floating boom system having a fixed terminus that is secured to a shoreline structure, the floating boom system comprising a plurality of flotation units and a curtain suspended from the flotation units; and connecting a portion of floating boom system to the boom support arm, between the fixed terminus and the second end of the support arm, using the one or more elastic connectors;

wherein the boom support arm supports the portion of the floating boom system and thereby inhibits damage to the floating boom system as the boom system oscillates between high and low water levels.

16. The method according to claim 15 wherein the length of the boom arm is about three to about six times the distance between high and low water levels at the shoreline structure.

17. The combination according to claim 16 wherein the length of the boom arm is about four times the distance between high and low water levels at the shoreline structure.

* * * * *

UNITED STATES PATENT AND TRADEMARK OFFICE

CERTIFICATE OF CORRECTION

PATENT NO. : 7,637,693 B2
APPLICATION NO. : 10/994718
DATED : December 29, 2009
INVENTOR(S) : Harold B. Dreyer It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1071 days.

Signed and Sealed this

Twenty-first Day of December, 2010

David J. Kappos

David J. Kappos
*Director of the United States Patent and Trademark Office*